United States Patent [19]

Karydas

[11] Patent Number: 4,769,160

[45] **Date of Patent: * Sep. 6, 1988**

[54] USE OF ORGANIC FLUOROCHEMICAL COMPOUNDS WITH OLEOPHOBIC AND HYDROPHOBIC GROUPS IN ASPHALTENIC CRUDE OILS AS VISCOSITY REDUCING AGENTS

[75] Inventor: Athanasios Karydas, Brooklyn, N.Y.

[73] Assignee: Ciba-Geigy Corporation, Ardsley, N.Y.

[ * ] Notice: The portion of the term of this patent subsequent to Aug. 30, 2005 has been disclaimed.

[21] Appl. No.: 892,213

[22] Filed: Jul. 31, 1986

[51] Int. Cl.[4] ..... F17D 1/16; E21B 43/00

[52] U.S. Cl. ..... 252/8.551; 137/13; 166/304; 252/8.3

[58] Field of Search ..... 252/8.551, 8.552, 8.3; 137/13; 166/304

[56] References Cited

U.S. PATENT DOCUMENTS

| | | | |
|---|---|---|---|
| 2,436,144 | 2/1948 | Howk et al. | 260/87 |
| 2,592,069 | 4/1952 | Reid | 260/89.1 |
| 2,732,370 | 1/1956 | Codding | 260/91.1 |
| 3,282,905 | 11/1966 | Fasick et al. . | |
| 3,346,612 | 10/1967 | Hansen | 260/456 |
| 3,398,182 | 8/1968 | Guenthner et al. | 260/455 |
| 3,491,169 | 1/1970 | Raynolds et al. | 260/900 |
| 3,492,374 | 1/1970 | Bleu et al. | 260/950 |
| 3,575,890 | 4/1971 | Litt et al. | 260/2 |
| 3,575,899 | 4/1971 | Pryor et al. | 260/17.4 |
| 3,681,329 | 8/1972 | Litt et al. | 260/244 |
| 3,708,537 | 1/1973 | Groves | 260/556 F |
| 3,776,247 | 12/1973 | Choufoer et al. | 137/13 |
| 3,828,098 | 8/1974 | Gilleo et al. | 260/481 R |
| 3,935,277 | 1/1976 | Dear et al. | 260/609 R |
| 3,943,954 | 3/1976 | Flournoy et al. | 137/13 |
| 3,989,725 | 11/1976 | Brace | 260/346.3 |
| 3,993,744 | 11/1976 | Cella et al. | 424/70 |
| 4,001,305 | 1/1977 | Dear et al. | 260/486 H |
| 4,046,944 | 9/1977 | Mueller et al. | 428/262 |
| 4,054,592 | 10/1977 | Dear et al. | 560/25 |
| 4,060,681 | 11/1977 | Kleiner et al. | 560/222 |
| 4,107,055 | 8/1978 | Sukornick et al. | 252/8.6 |
| 4,195,105 | 3/1980 | Mares et al. | 427/386 |
| 4,202,706 | 5/1980 | Newell et al. | 148/6.17 |
| 4,219,625 | 8/1980 | Mares et al. | 525/5 |
| 4,243,658 | 1/1981 | Chang | 424/52 |
| 4,268,598 | 5/1981 | Leseman et al. | 430/107 |
| 4,293,441 | 10/1981 | Newell et al. | 252/389 |
| 4,302,378 | 11/1981 | Lindner et al. | 260/31.6 |
| 4,425,242 | 1/1984 | Penny et al. | 166/308 X |
| 4,432,882 | 2/1984 | Raynolds et al. | 252/8.551 |
| 4,460,791 | 7/1984 | Cooke | 568/45 |
| 4,557,837 | 12/1985 | Clark, III et al. | 252/8.55 |

OTHER PUBLICATIONS

CA 72:21502s, p. 292 (1970) of German 1,916,651.
CA 72:80290u, p. 73 (1970) of German 1,938,544.
CA 72:132093d, p. 305 (1970) of German 1,938,545.
CA 73:98585z, p. 343 (1970) of German 1,956,198.
Derwent Abstract 37755w/23 (5/1975) of German 1,966,931.
CA 74:23608w, p. 37 (1971) of German 2,009,781.
Derwent Abstract 79326r-ADEF (10/1970) of German 2,016,423.
Derwent Abstract 76974r-AEF (10/1970) of German 2,017,399.
CA 77:77088g, p. 117 (1972) of German 2,154,574.
Derwent Abstract 21482u (4/1973) of German 2,245,722.
CA 81:37246h, p. 362 (1974) of German 2,344,889.
CA 81:63131m, p. 427 (1974) of German 2,357,780.
CA 85:110392s, p. 106 (1976) of German 2,559,189.
Derwent Abstract 07945y/05 (1/1977) of German 2,628,776.
CA 91:38923v, p. 584 (1979) of German 2,744,044.
Derwent Abstract 42486a/24 (6/1978) of German 2,753,095.
Derwent Abstract 31376c/18 (1980) of German 2,941,473.
CA 101:191170s, pp. 699-700 (1984) of German 3,233,830.
Derwent Abstract 27737k/12 (3/1983) of European 74,057.
CA 103:89302r, p. 83 (1985) of European 140,525.
Derwent Abstract 02.002q (3/1968) of British 1,106,641.
CA 79:20241p, p. 84 (1973) of British 1,296,426.
CA 100:176906x, p. 113 (1984) of French 2,530,623.
CA 82:4008z, p. 344 (1975) of Swiss 549,551.
CA 75:141944w, p. 54 (1971) of Japanese 45/38,759.
CA 77:153838u, p. 94 (1972) of Japanese 47/16,279.
CA 87:128902j, p. 219 (1977) of Japanese 51/144,730.
Derwent Abstract 32911a/18 (3/1978) of Japanese 53/31,582.
CA 99:89902k, p. 97 (1983) of Japanese 58/70,806.
CA 104:52043b, p. 63 (1986) of Japanese 60/151,378.
CA 104:51691z, p. 39 (1986) of Japanese 60/181,141.
CA 87:203421g, p. 89 (1977) of Japanese 77/88,592.
Text Res. J. 47 (8), pp. 551-561 (1977).

*Primary Examiner*—Herbert B. Guynn
*Attorney, Agent, or Firm*—Luther A. R. Hall; Irving M. Fishman

[57] ABSTRACT

A method of reducing a viscosity of asphaltenic crude oils by incorporating into said crude oil an effective viscosity reducing amount of an oil soluble organic compound having at least one oleophobic and hydrophobic fluoroaliphatic group, and optionally a low viscosity diluent, and compositions thereof.

13 Claims, No Drawings

USE OF ORGANIC FLUOROCHEMICAL COMPOUNDS WITH OLEOPHOBIC AND HYDROPHOBIC GROUPS IN ASPHALTENIC CRUDE OILS AS VISCOSITY REDUCING AGENTS

BACKGROUND OF THE INVENTION

The present invention relates to an improved method of pumping and/or transporting viscous asphaltenic crude oils. More particularly, the present invention relates to the introduction into crude oils of an effective viscosity reducing amount of an oil soluble or oil-dispersible organic compound containing at least one oleophobic and hydrophobic fluoroaliphatic group.

Crude oils are complex mixtures comprising hydrocarbons of widely varying molecular weights, i.e. from the very simple low molecular weight species including methane, propane, octane and the like to those complex structures whose molecular weights approach 100,000. In addition, sulfur, oxygen and nitrogen containing compounds may characteristically be present. Further, the hydrocarbyl constituents may comprise saturated and unsaturated aliphatic species and those having aromatic character.

By a variety of fractionation procedures crude oils can be separated into various classes, the most common of which is boiling range. The mixtures which are in the lower boiling ranges generally consist of materials of relatively simple structures. The mixtures which are in the high boiling point ranges comprise substances which, with the exception of paraffins, are so complex that broad terms are applied to them such as resins and asphaltenes. Resins are poorly characterized but are known to be highly aromatic in character and are generally thought to be high molecular weight polynuclear aromatic hydrocarbons which melt over a wide, elevated temperature range.

Asphaltenes are aromatic-base hydrocarbons of amorphous structure. They are present in crude oils in the form of colloidally dispersed particles. The central part of the asphaltene micelle consists of high-molecular weight compounds surrounded and peptized by lower weight neutral resins and aromatic hydrocarbons. Asphaltene content generally increases with decreasing API gravity. The components of asphaltic materials are classified by their physical properties. Neutral resins are soluble in petroleum oils including $C_5$ fractions while the asphaltenes are insoluble in light gasoline and petroleum ether. Asphaltenes are lyophobic with respect to low-molecular-weight paraffinic hydrocarbons and lyophilic with respect to aromatics and resins. The aromatics and resins peptize the asphaltene particle by adsorption on its surface, resulting in dispersion of the particle in the oil.

Any action of chemical, electrical or mechanical nature that depeptizes the asphaltene micelle may lead to flocculation and precipitation of the asphaltenes from the crude oil. The addition of low-surface-tension liquids—i.e. below 24 dyne/cm at 25° C., such as gasoline, pentane, hexane, petroleum naphtha, etc. may precipitate asphaltenes. The addition of HCl during acidizing also tends to cause the formation of precipitated asphaltic-acid sludges. The flow of crude oil through porous media may also result in the precipitation of asphaltenes because of the neutralization of their charge by the streaming potential.

Asphaltene deposits are characteristically hard, brittle, dark black, dry solids, similar in appearance to coal and other bitumens. These deposits are very difficult to remove from a system because typical thermal methods of hot oil or water treatment are generally totally ineffective. The deposition of these materials also constricts or blocks the passage of crude oil causing reduced efficiency of production. Prevention or removal can be attempted chemically through the use of aromatic solvents, solvent accelerators, or the resinous components of crudes, or mechanically through tedious cutting operations.

Viscosity frequently limits the rate crude oil can be produced from a well. For example, in wells that are pumped by a sucker rod string, viscous drag by the crude oil on the string slows its free fall by gravity on the downstroke. On the upstroke, this drag also slows the string, decreases oil flow through the production tubing, and increases the power required to raise oil and rod string. In some instances where the oil is highly viscous, such as the Boscan field in Venezuela, the strength of the sucker rods limits the depth at which the pump can be operated. Alternatively, hydraulic pumps can be placed at the bottom of the well, but they must still overcome the high viscous drag that requires high power oil pressures and high pump horsepower.

The downhole pump usually provides the pressure required to pump the produced oil from the wellhead to surface gathering tanks. Where viscosity is high, this may require the use of extra strength wellhead equipment (packings, gaskets, heavy walled pipes and the like) to withstand the pressures required to move such viscous oil from wellhead to storage tank.

It has been proposed heretofore to reduce the viscosity of heavy crude oils prior to pumping by introducing low viscosity crude oils, white oil, kerosene or the like into the well bore to dilute or thin the produced crude. In rod pumped wells, it is common to surround the sucker rod string with an extra tubing. Low viscosity oil is pumped down this tubing so that the string is surrounded by lower viscosity oil. This added light oil then mixes with the viscous crude near the traveling valve of the pump to lighten and thin the column of crude oil being pumped from the well through the annulus formed by the inner and the production tubings of the well. Alternatively, low viscosity oil can be pumped down hollow sucker rods and the diluted crude oil produced through the annulus between the hollow rod string and the tubing.

The resulting produced crude has reduced viscosity and is more economically transported; However, these low viscosity diluents are expensive and not always available and have to be reclaimed from the diluted crude.

Another method for reducing the viscosity of asphaltic crudes is transporting them at elevated temperatures. This method however, is very expensive because the decrease in viscosity per degree temperature increase is very low.

Other approaches that have been suggested to reduce viscosity of asphaltic crudes include the use of aqueous surfactant solutions to form low viscosity oil in-water emulsion as shown in U.S. Pat. Nos. 3,943,954, 4,265,264, 4,429,554 and 4,239,052. Such emulsions generally contain a rather high percent water, for example 10–40% water, which must be removed. Removal is not always easy and yields large volumes of water contaminated with oil. High treating temperatures are required for separation of the water and this results in additional expenditures. Also, corrosion problems, freezing problems, and emulsion inversion into highly viscous water in oil emulsions problems may be associated with such aqueous emulsions, depending upon the nature of the field conditions, local climate, and the like.

It is thus an object of the present invention to obviate many of the drawbacks and deficiencies associated with the various prior art techniques that are presently used in the attempt to diminish the problems associated with the production, transportation and storage of crude oils. This object is achieved by employing oil soluble or oil-dispersible organic compounds having at least one oleophobic and hydrophobic fluoroaliphatic group which are viscosity reducers when dissolved or dispersed in such oils.

SUMMARY OF THE INVENTION

The present invention relates to a method of reducing the viscosity of an asphaltenic crude oil by incorporating into said crude oil an effective viscosity reducing amount of an oil soluble organic compound having at least one oleophobic and hydrophobic fluoroaliphatic group, said group having between about 4 to about 20 carbon atoms, optionally in the further presence of a low viscosity diluent.

In the context of the present invention, an asphaltenic crude oil is a crude oil containing at least about 1% by weight, generally between about 1% and about 30% by weight, preferably between about 2% and about 20% by weight, and most preferably between about 5% and about 20% by weight, of asphaltenes based on the weight of crude oil. Such asphaltenes, in contrast for example to neutral resins, are precipitated in an excess of petroleum ether.

Preferably, the fluoroaliphatic group-containing oil soluble organic compound is added to the pipeline or well bore of the asphaltene containing hydrocarbon crude oil. In order to insure rapid and efficient dissolution and dispersion of the fluoroaliphatic oil soluble organic viscosity reducing compound into the asphaltenic crude oil, the fluoroaliphatic compound may conveniently be added to the crude oil as a solution or semiliquid by dilution of the viscosity reducer in a liquid organic asphaltenic oil soluble carrier.

Advantageously, useful fluoroaliphatic oil soluble organic compounds are those exhibiting a solubility in the asphaltenic crude oil to be treated of at least 10 ppm by weight at 80° C., which are sufficiently oleophobic such that a steel coupon treated with the fluoroaliphatic compound gives a contact angle with hexadecane of fifteen degrees or more; and wherein the fluorine content is generally between about 1 and about 70 weight percent of the fluoroaliphatic compound. Useful guides in selecting highly preferred fluoroaliphatic compounds in reducing viscosity in the field are found in the laboratory screening techniques described hereinafter.

Characteristically, the viscosity of the asphaltenic crude in centipoise in the environment of use, e.g. in the pipeline a wellbore, is reduced by at least about 5%, preferably at least about 10%, more perferably at least about 15%, and most preferably at least about 25%, where the fluorochemical is present in the asphaltenic crude in a concentration of between about 10 to about 500 parts per million by weight. As the action can appreciate, additional amounts of fluorochemical, may, if desired or appropriate be present in the asphaltenic crude oil.

Where a conventional inert low viscosity diluent is employed in conjunction with the fluorochemical, the diluent may be present in an amount of between 1% and 80 percent by weight, based on the total weight of the composition, preferably between about 5% to about 50% by weight of the composition. Characteristically, such diluents possess a viscosity at 20° C. between about 25 and about 300 centipoise, preferably between about 25 and about 200 centipoise.

An alternate embodiment of the present invention related to a viscosity reduced asphaltenic crude oil composition containing, in the dissolved and dispersed state in such oil, an effective viscosity reducing amount of the fluoroaliphatic asphaltenic oil soluble compound, and optionally a low viscosity diluent.

These and other objects of the present invention are apparent from the following specific disclosures.

DETAILED DESCRIPTION OF THE INVENTION

Generally, suitable oil soluble organic compounds containing at least one oleophobic and hydrophobic fluoroaliphatic group can be represented by the formula $$[(R_f)_nR']_mZ \qquad (I)$$

wherein $R_f$ is an inert, stable, oleophobic and hydrophobic fluoroaliphatic group having about 4 to about 20 carbon atoms;

n is an integer from 1 to 3;

R' is a direct bond or an organic linking group having a valency of n+1 and is covalently bonded to both $R_f$ and Z;

m is an integer of from 1 to about 5000; and

Z is a hydrocarbyl containing residue having a valency of m and being sufficiently oleophilic so as to impart an oil solubility to said compounds of at least 10 parts by weight per million parts of hydrocarbon crude oil.

Suitable $R_f$ groups include straight or branched chain perfluoroalkyl having 4 to 20 carbon atoms, perfluoroalkoxy substituted perfluoroalkyl having a total of 4 to 20 carbon atoms, omega-hydro perfluoroalkyl of 4 to 20 carbon atoms, or perfluoroalkenyl of 4 to 20 carbon atoms. If desired, the $R_f$ group may be a mixture of such moieties.

The integer n is preferably 1 or 2.

Where n is 1, R' may be a direct bond or a divalent organic linking group. The nature of the divalent organic linking group R', when present, is not critical as long as it performs the essential function of bonding the fluoroaliphatic group, $R_f$, to the oleophilic organic radical Z.

In one sub-embodiment, R' is an organic divalent linking group which covalently bonds the $R_f$ group to the group Z.

Thus, R' may, for example, be a divalent group, R°, selected from the following

-$C_1$–$C_8$ alkylene-,
-phenylene-,
-$C_1$–$C_8$ alkylene-$R_1$-$C_1$-$C_8$ alkylene-,
-$C_1$–$C_8$ alkylene-$R_1$-,
-$R_1$-$C_1$–$C_8$ alkylene-,
-$R_1$-$C_1$–$C_8$ alkylene-$R_1$'-,
-$R_1$-,
-$R_1$-phenylene-,
-$R_1$-phenylene-$R_1$-, -$R_1$-phenylene-$C_1$–$C_8$ alkylene-, or
-phenylene-$R_1$-,
wherein, in each case, said alkylene and phenylene are independently unsubstituted or substituted by hydroxy, halo, nitro,carboxy, $C_1$–$C_6$ alkoxy, amino, $C_1$–$C_6$ alkanoyl, $C_1$–$C_6$ carbalkoxy. $C_1$–$C_6$ alkanoyloxy or $C_1$–$C_6$ alkanoylamino. The alkylene moiety may be straight or branched chain or contain cyclic alkylene moieites, such as cycloalkylene or norbornylene. $R_1$and $R_1'$ independently represent: —N($R_2$)—, —CO—, —N($R_2$)CO—, —CON($R_2$)—, —N($R_2$)COO—, —OCO—N($R_2$)—, —S—, —SO—, —$SO_2$—, —N($R_2$)$SO_2$—, —$SO_2$N($R_2$)—, —N($R_2$)CON($R_2$)—, —COO—, —OCO—, —$SO_2$O—, —O$SO_2$O, —OCOO—,

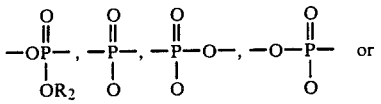

—O—, where $R_2$ is hydrogen, $C_1$–$C_6$ alkyl substituted by: $C_1$–$C_6$ alkoxy, halo, hydroxy, carboxy, $C_1$–$C_6$ carbalkoxy, $C_1$–$C_6$ alkanoyloxy or $C_1$–$C_6$ alkanoylamino Also, if desired, the amino group —N($R_2$)—, above, may be in quaternized form, for example of the formula

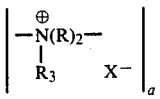

wherein a is 1, $R_3$ is hydrogen or $C_1$–$C_6$ alkyl which is unsubstituted or substituted by hydroxy, $C_1$–$C_6$ alkoxy, $C_1$–$C_6$ alkanoyloxy or $C_1$–$C_6$ carbalkoxy and X is an anion, such as halo, sulfato, lower alkylsulfato such as methylsulfato, lower alkyl-sulfonyloxy such as methylsulfonyloxy, lower alkanoyloxy such as acetoxy or the like.

As an alternate sub-embodiment, R', while being covalently bonded to both $R_f$ and Z may contain an ionic bridging group as an integral part of the chain linking $R_f$ to Z.

Thus, for example, R' may be selected from the following:

$$-(R_a')_s Q^{\oplus\ominus} T(R_b')_t$$

or $$-(R_a')_s T^{\ominus\oplus} Q(R_b')_t$$

where $R_a'$ is -$C_1$–$C_8$ alkylene-, -phenylene-, -$C_1$–$C_8$ alkylene-$R_1$-$C_1$-$C_8$ alkylene-, -$R_1$-$C_1$–$C_8$ alkylene-, -$R_1$-phenylene- or -$R_1$-phenylene-$C_1$–$C_8$ alkylene-,;

$R_b'$ is -$C_1$–$C_8$ alkylene, -phenylene-, -$C_1$–$C_8$ alkylene-, $R_1$–$C_1$–$C_8$ alkylene-, -$C_1$–$C_8$ alkylene-$R_1$-, -phenylene-$R_1$- or -$C_1$–$C_8$ alkylene-phenylene-$R_1$-; s and t are independently 0 or 1; T is an anionic group, $R_f$ is as defined above and Q is a cationic group and wherein said alkylene and phenylene unsubstituted or substituted by hydroxy, halo, nitro, carboxy, $C_1$–$C_6$ alkoxy, amino, $C_1$–$C_6$ alkanoyl, $C_1$–$C_6$ carbalkoxy, $C_1$–$C_6$ alkanoyloxy or $C_1$–$C_6$ alkanoylamino.

Suitable anionic groups for T include carboxy, sulfoxy, sulfato, phosphono, and phenolic hydroxy. Suitable cationic groups for Q include amino and alkylated amino, such as those of the formula

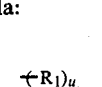

where each $R_2$ and $R_3$ are as defined above.

Where n is 2 and m is 1, R' is an organic trivalent group. Suitable such groups include those of the formula:

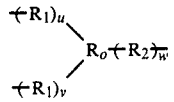

wherein $R_1$ and $R_2$ are defined above; u, v and w are independently 1 or 0 and $R_o$ is alkanetriyl, arenetriyl or aralkanetriyl of up to 18 carbon atoms which may be interrupted by one or more hetero atoms, and as oxygen, sulfur or imino.

The oleophilic organic radical Z can vary widely and is, in general, not critical, as long as the group performs the essential function of conferring the requisite oil solubility to the compound.

For example, suitable oleophilic organic radicals, when m is 1 include, without limitation, conventional hydrophobic-oleophilic higher alkyl or alkenyl of 6–24 carbon atoms which are unsubstituted or substituted e.g. by chloro, bromo, alkoxy of up to 18 carbon atoms, nitro, alkanoyl of up to 18 carbon atoms, alkylmercapto of up to 18 carbon atoms $C_1C_{18}$ alkylamino, or di-$C_1$–$C_{18}$ alkylamino; an aryl group, such as phenyl or naphthyl, the phenyl and naphthyl moiety of which is unsubstituted or substituted by alkyl of up to 20 carbon atoms, alkoxy of up to 20 carbon atoms, alkanoyl of up to 20 carbon atoms, alkanoyloxy of up to 20 carbon atoms or mono- or di-alkylamino of up to 20 carbon atoms; mono- or di-$C_6$-$C_{24}$-alkylamino-$C_2$–$C_7$- alkylene; alkoxyalkylene of 4–20 carbon atoms which is unsubstituted or substituted by one or two $C_6$–$C_{24}$ carbalkoxy or $C_6$–$C_{24}$ carbamoyl groups; poly-$C_6$-$C_{24}$alkoxy-higher alkyl or alkenyl of 6–24 carbon atoms; a heterocyclic group such as piperidino, piperazino, azepino, N-pyridinium, morpholino, benztriazolyl, triazinyl, pyrrolidino, furanyl, tetrahydrofuranyl and the like, which are unsubstituted or substituted e.g. by halo, alkoxy of up to 18 carbon atoms, nitro, alkanoyl of up to 18 carbon atoms, alkylmercapto of up to 18 carbon atoms, amino or alkylamino of up to 18 carbon atoms; poly-$C_2$-$C_3$alkoxy-phenyl, the phenyl group of which is unsubstituted or substituted by alkyl of up to 20 carbon atoms; a group of the formula —$(CH_2CH_2CH_2CH_2O)_gH$ and g is 2–80; a group of the formula $$-(CH_2CH_2O)_b(CH_2\overset{CH_3}{\overset{|}{C}}HO)_c(CH_2CH_2O)_dH$$

wherein b is 2–40, c is 2–80, and d is 2–40; a group of the formula

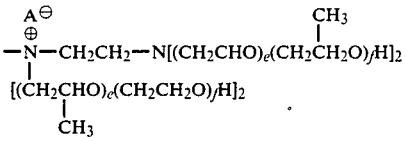

wherein each e is 3–20, and each f is 3–20 and A is an anion; a group of the formula

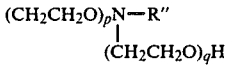

where p is 1–15 and q is 1–15 and R'' is akyl of 6 to 22 carbon atoms or alkanoyl of 6 to 22 carbon atoms; or a group of the formula

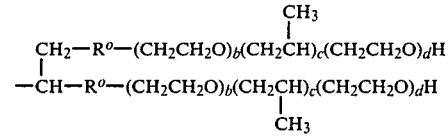

where $R^o$,b, c and d are as defined above.

Also, where m is 2 or 3, Z represents an oleophilic organic divalent or trivalent radical. Suitable such radicals include those wherein Z is an oleophilic di- or trivalent aliphatic, carbocyclic, heterocyclic or aromatic group. For example, when m is 2, Z may represent an oleophilic polyalkyleneoxy containing group, the terminal members of which are covalently bonded to R'; an arylene group, such as phenylene or naphthalene which are unsubstituted or substituted, e.g. by alkyl up to 20 carbon atoms, alkoxy of up to 20 carbon atoms, alkanoyloxy of up to 20 carbon atoms, alkanoylamino of up to 20 carbon atoms, halo, amino or alkylamino of up to 20 carbon atoms, or the like; an alkylene or alkenylene group of up to 20 carbon atoms which is unsubstituted or substituted, e.g. by alkoxy of up to 20 carbon atoms, alkylamino of up to 20 carbon atoms, alkanoyl of up to 20 carbon atoms, alkanoylamino of up to 20 carbon atoms, or alkanoyloxy of up to 20 carbon atoms; a heterocyclic group, such as N, N'piperazinylene, triazinylene, or the like.

An alternate group of oil soluble compounds according to formula I are those wherein the $R_f$ group is pendant to an oleophilic polymer backbone.

Suitable oleophilic polymer backbones are those derived from condensation polymers and addition polymers.

For example, the group Z may contain condensation units of the formula:

$$(O\text{-}R_3\text{-}OCONH\text{-}D\text{-}NHCO)_m$$

wherein $R_3$ is an aliphatic triradical or tetraradical of 2–50 carbon atoms which is covalently bonded to the $(R_f)_nR'$ groups and is selected from the group consisting of branched or straight chain alkylene, alkylenethioalkylene, alkyleneoxyalkylene or alkyleneiminoalkylene; and D, together with the —NHCO groups to which it is attached, is the organic divalent radical of a diisocyanate.

In a preferred subembodiment, D is alkylene of 2 to 16 carbon atoms; cycloaliphatic of 6to 24 carbon atoms; phenylene that is unsubstituted or substituted by lower alkyl, lower alkoxy or chloro;diphenylene; phenyleneoxyphenyl, phenylene (lower alkylene) phenylene, or naphthylene, where the aromatic ring is otherwise unsubstituted or substituted by lower alkyl, lower alkoxy or chloro. In an alternate embodiment, up to about 85 percent of the $[(R_f)_nR']_mR_3$ groups may be replaced by the biradical of a bis(2-aminopropyl) ether of a polyethylene oxide; an aliphatic polyol of up to 18 carbon atoms; a di- or polyalkoxylated aliphatic or aromatic tertiary amine of up to 18 carbon atoms; a lower alkylene polyether; or a hydroxyterminated polyester having a hydroxyl number from 40 to 500.

Suitable preferred condensation polymers and their preparations are described, inter alia, in U.S. Pat. Nos. 3,935,277, 4,001,305, 4,046,944 and 4,054,592.

Suitable oleophilic polymer backbones derived from addition polymers comprising the group Z include those wherein up to about 5000 groups of the formula $(R_f)nR'$- are attached to an oleophilic hydrocarbyl containing polymeric backbone. Suitable polymers include those wherein the addition polymer contains up to about 5000 units of the formula

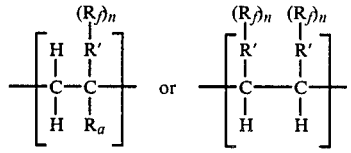

wherein $R_f$, n and R' are defined above, and $R_a$ is hydrogen or lower alkyl. Preferably $R_a$ is hydrogen or methyl.

Such addition polymers are generally prepared, by methods known in the art, e.g. in U.S. Pat. Nos. 3,282,905, 3,491,169 and 4,060,681, by homo- or copolymerizing the corresponding monomer of the formula

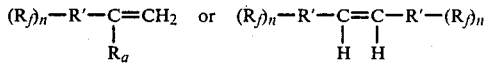

wherein $R_f$, n, R', and $R_a$ are defined above, optionally with polymerizable vinylic comonomers.

Suitable comonomers include:

Ethylene and chloro, fluoro- and cyano- derivatives of ethylene such as vinyl chloride, vinylidene chloride, vinyl fluoride, vinylidene fluoride, acrylonitrile, methacrylonitrile, tetrafluoroethylene, trifluorochloroethylene, hexafluoropropylene; acrylate and methacrylate monomers, particularly those with 1 to 12 or 18 carbon atoms in the ester groups such as n-propyl methacrylate, 2-methyl cyclohexyl methacrylate, methyl methacrylate, t-butyl methacrylate, n-butyl methacrylate, methyl acrylate, ethyl acrylate, propyl acrylate, butyl acrylate, 3-methyl-1-pentyl acrylate, octyl acrylate, tetradecyl acrylate, s-butyl acrylate, 2-ethylhexyl acrylate, 2-methoxyethyl acrylate, and phenyl acrylate; dienes particularly 1, 3-butadiene, isoprene, and chlorprene, 2-fluoro-butadiene, 1,1,3-trifluorobutadiene, 1,1,2,3-tetrafluoro butadiene, 1,1,2-trifluoro-3,4-dichlorobutadiene and tri- and pentafluoro butadiene and isoprene; nitrogen-vinyl monomers such as vinyl pyridine, N-vinylimides, amides, vinyl succinimide, vinyl pyrrolidone, N-vinyl carbazole and the like;

styrene and related monomers which copolymerize readily with the novel esters of this invention such as o-methylstyrene, p-methylstyrene, 3,4-dimethyl styrene, 2,4,6-trimethyl styrene, m-ethyl styrene, 2,5-diethyl styrene;

vinyl esters, e.g. vinyl acetate, vinyl esters of substituted acids, such as for example, vinyl methoxyacetate, vinyl trimethylacetate, vinyl isobutyrate, isopropenyl butyrate, vinyl lactate, vinyl caprylate, vinyl pelargonate, vinyl myristate, vinyl oleate and vinyl linoleate; vinyl esters of aromatic acids, such as vinyl benzoate;

alkyl vinylethers, such as methyl vinyl ether, isopropyl vinyl ether, isobutyl vinyl ether, 2-methoxy ethyl vinyl ether, n-propyl vinyl ether, t-butyl vinyl ether, isoamyl vinyl ether, n-hexyl vinyl ether, 2-ethylbutyl vinyl ether, diisopropylmethyl vinyl ether, 1-methylheptyl vinyl ether, n-decyl vinyl ether, n-tetradecyl vinyl ether, and n-octadecyl vinyl ether.

Propylene, butylene and isobutylene are preferred $\alpha$-olefins useful as comonomers with the novel fluoro monomers of the present invention with straight and branched chain $\alpha$-olefins useful with up to 18 carbon atoms in the side chain.

Suitable candidate compounds of the formula I containing one or more inert stable oleophobic and hydrophobic fluoroaliphatic groups, $R_f$, and an oleophilic hydrocarbyl containing residue, represent a well known class of compounds widely described in the literature.

For example, compounds of the formula I wherein n and m are 1 are described in U.S. Pat. Nos. 4,460,791; 4,302,378; 3,575,899; 3,575,890; 4,202,706; 3,346,612; 3,575,899; 3,989,725; 4,243,658; 4,107,055; 3,993,744; 4,293,441; 4,107,055; 3,839,343; JP No. 77/88,592; Ger. Offen. No. 1,966,931; Ger. Offen. No. 2,245,722; JP No. 60/181,141; EP 140,525; JP No. 53/31582; CH 549,551; EP 74,057; FR 2,530,623; Ger. Offen. No. 2,357,780; JP No. 58/70806; Ger. Offen. No. 2,344,889; U.S. 3,575,890; U.S. 3,681,329; Ger. Offen. No. 2,559,189; U.S. Pat. Nos. 3,708,537; 3,838,165; 3,398,182 Ger. Offen. No. 2,016,423; Ger. Offen No. 2,753, 095, Ger. Offen. No. 2,941,473; Ger. Offen. No. 3,233,830; JP No. 45/38,759; JP No. 51/144,730; Ger. Offen. No. 3,856,616; Ger. Offen. No. 2,744,044; JP No. 60/151,378; Ger. Offen. No. 1,956,198; and GB 1,106,641.

Compounds of the formula I wherein n is 2 or 3, or m is 2 to 4 are described, for example, in U.S. Pat. No. 4,219,625; Ger. Offen. No. 2,154,574; Ger. Offen. 2,628,776., Text. Res. J., 47 (8), 551-61 (1977); U.S. Pat. No. 4,268,598; U.S. Pat. No. 3,828,098; Ger. Offen. No. 1,938,544; Ger. Offen, 2,017,399; Ger. Offen. No. 2,628,776; Ger. Offen. No. 1,956,198; JP No. 47/16279; Ger. Offen. No. 1,938,545; Ger. Offen. 1,916,651; U.S. Pat. Nos. 3,492,374; 4,195,105; Ger. Offen, 2,009,781; U.S. Pat. No. 4,001,305; and GB No. 1,296,426.

Compounds where n is 1 to 3 and m is in excess of 4, up to for example about 500, are described, inter alia, in U.S. Pat. Nos. 3,935,277; 2,732,370; 2,828,025; 2,592,069; 2,436,144; 4,001,305; 4,046,944; 4,054,592; 4,557,837; 3,282,905, 3,491,169; and 4,060,681.

In a preferred embodiment of the invention, highly suitable candidate oil soluble compounds, containing at least one oleophobic and hydrophobic group, of the formula I useful as viscosity reducing agents in asphaltenic crudes, contain 1 to 70% fluorine; have a solubility in the asphaltenic crude oil of at least 10 ppm at 80° C.; are sufficiently hydrophobic such that a steel coupon treated with the fluoroaliphatic compound gives a contact angle with hexadecane of fifteen degrees or more; and possessing a viscosity reduction capability of at least about 10% as tested by adding the fluoroaliphatic compound to an asphaltenic crude in an amount of about 10 to about 500 parts per million parts crude, by weight, in combination with a low viscosity diluent compatable with said crude in a weight ratio of crude to diluent of about 3:1.

In selecting eligible compounds of formula I for use as viscosity reducing agents in asphaltenic oils, it has been found that those compounds repeatedly applied to the surfaces of steel coupons from e.g. a 5% by weight solution of candidate compound in a suitable volatile inert solvent, such as xylene, toluene, isopropyl acetate, methylene chloride, ethanol, water or miscible mixtures thereof, and air dried after each application, which render the metal coupon sufficiently oleophobic such that hexadecane exhibits a contact angle with the treated coupon of fifteen degrees or more, are characteristically suitable for use in the instant invention.

A second screening technique for oil soluble candidate compounds of formula I involves the laboratory determination of the comparative viscosity reduction of one part asphaltenic crude diluted with one-third part by weight of a low viscosity diluent, and which contains from 10 to 500 parts by weight candidate fluorochemical compound per million parts by weight asphaltenic crude oil. The nature of the low viscosity diluent is not critical, as long as it is compatable with the crude oil. Suitable diluents include, inter alia, kerosene, No. 2 fuel oil, diesel fuel, white oil, low viscosity aromatic containing crude oils and the like.

Generally, but not necessarily the instant viscosity reducing fluorochemical is employed in conjunction with a conventional low viscosity diluent in actual field use. The low viscosity diluent coupled with the flurochemical both act to economically and efficiently reduce the viscosity of the crude asphaltenic oil. The fluorochemical compound of formula I unexpectedly increases the efficiency of the viscosity reduction able to be obtained, thereby reducing the amount of diluent employed or obtaining a lower viscosity than obtainable without further increasing the amount of diluent employed.

In the following test descriptions and examples, all temperatures are given in degrees Centigrade, and all parts are understood to be parts by weight, unless otherwise indicated. The examples are for illustrative purposes only and are not intended to limit the scope of the invention.

DESCRIPTION OF LABORATORY TEST METHODS

1. Viscosity Reduction

The crude oil and diluent are placed in a closed container at a specific weight ratio, e.g. a ratio of 3 parts by weight crude to 1 part diluent. The container and its contents are weighed, heated in a draft oven at 75°–77° C. for 30 minutes, shaken twice during this heating period to mix, and then reweighed. The diluent that is lost during the thermal treatment is replaced. A Fann 35A/SR12 viscometer equipped with a closed-end rotor cup, a hollow bob, a double-wall circulating cup and a circulating bath is employed for the viscosity measurements. The oil diluent mixture which weighs approximately 30 g is poured into the closed-end rotor cup. The rotor cup is attached to the viscometer and lowered into a double-wall circulating cup which contains water as a heating medium. The temperature of the water is controlled by a circulating bath that is connected to the jacket of the double-wall circulating cup. The crude oil/diluent mixture is allowed to mix and equilibrate at 50° C. for 20 minutes at 100 RPM. Viscosities are then measured at 100 RPM at several temperatures between 20° and 50° C., beginning at 50° C. and cooling by 4 to 7° C. for each successive measurement. Once the desired temperature is obtained, the crude oil/diluent mix is stirred at 100 RPM for 20 minutes to ensure temperature equilibration. Total time for cooling and equilibration for each measurement is generally one hour. Finally, the viscosity is remeasured at 50° C. to indicate the stability of the sample and reproducibility of the results.

The above procedure is repeated with a slight modification. The additive compound, in an amount of between 10 and 500 parts per million in weight is dissolved in the diluent. To this is added the oil. The container is closed and the above procedure for thermal treatment and viscosity measurement is followed.

2. Hexadecane Contact Angle

Degreased steel coupons (SAE 1010 ½"×3"×⅛") are dipped for one minute in a 5% solution of fluorochemical in a suitable solvent, then are removed and air-dried for one minute. The procedure is repeated five times and the coupons are air-dried for at least 30 minutes. Contact angles with hexadecane are determined using a Raume-Hart contact angle goniometer. Hexadecane is used as a testing liquid due to its structural resemblance to paraffin wax and ease of handling. The contact angle of hexadecane with untreated steel coupons is zero degress; for a fluorochemical to be considered effective the contact angle for the coated coupon should be at least fifteen degrees.

DESCRIPTION OF CRUDE OILS

Crude oil A is an asphaltenic crude from offshore Italy and it has a viscosity of 34,5000 cP at 25° C. Its estimated asphaltene content is 9% and it has an API gravity of 14°.

Crude oil B is an asphaltenic crude from Canada and it has a viscosity of 19,500 cP at 25° C. Its estimated asphaltene content is 12% and it has an API gravity of 12°.

Crude oil C is an asphaltenic crude from Nebraska and it has a viscosity of 2,900 cP at 25° C. Its estimated asphaltene content is 5% and it has an API gravity of 25°.

DESCRIPTION OF DILUENTS

Diluent A is a commercial condensate having an API gravity of 59° and aromatic to aliphatic carbon ratio 1 to 19 as determined by 13C spectroscopy.

Diluent B is a condensate having an API gravity of 54° and aromatic to aliphatic carbon ratio 1 to 4 as determined by $^{13}C$ spectroscopy.

Diluent C is a #2 fuel having an API gravity of 35° and aromatic to aliphatic carbon ratio 1 to 4 as determined by $^{13}C$ spectroscopy.

EXAMPLE 1

This example is comparative and demonstrates the superiority of a fluorinated compound over a non-fluorinated analog of similar structure in reducing the viscosity of a diluted crude oil. Crude oil A was mixed with diluent A in weight ratio 3 to 1 and the mixture viscosity was determined as previously described.

Two fresh samples were doped, one with 250 ppm of a compound E of the formula $$HO(CH_2CH_2O)_6(\underset{\underset{CH_3}{|}}{CH}CH_2O)_{56}(CH_2CH_2O)_6H$$

and the other with 250 ppm of a compound F of the formula:

$$C_6F_{13}CH_2CH_2SCH_2\underset{\underset{CH_2OH}{|}}{CH}-O(CH_2CH_2O)_6(\underset{\underset{CH_3}{|}}{CH}CH_2O)_{56}(CH_2CH_2O)_6H$$

according to the doping method previously described.

Results of the viscosity measurements are summarized below:

| Sample | 10° C. Visc. (cP) | 10° C. % Reduction | 20° C. Visc. (cP) | 20° C. % Reduction | 30° C. Visc. (cP) | 30° C. % Reduction | 40° C. Visc. (cP) | 40° C. % Reduction | 50° C. Visc. (cP) | 50° C. % Reduction |
|---|---|---|---|---|---|---|---|---|---|---|
| Control | 715 | — | 361 | — | 191 | — | 105 | — | 61 | — |
| Doped with E | 682 | 5 | 365 | 0 | 199 | 0 | 113 | 0 | 63 | 0 |
| Doped with F | 481 | 33 | 254 | 30 | 140 | 27 | 81 | 24 | 48 | 21 |

EXAMPLES 2–7

The effectiveness of compounds of the formula $$C_6F_{13}CH_2CH_2SCH_2\underset{\underset{CH_2OH}{|}}{CH}-O(CH_2CH_2O)_a(\underset{\underset{CH_3}{|}}{CH}CH_2O)_b(CH_2CH_2O)_aH$$

as viscosity reducers was determined. Crude oil A and diluent A were used in weight ratio 3 to 1. The diluted crudes contained 250 ppm of fluorochemical.

| Example # | a, b | 20° C. Visc. (cP) | 20° C. % Reduction | 30° C. Visc. (cP) | 30° C. % Reduction | 40° C. Visc. (cP) | 40° C. % Reduction | 50° C. Visc. (cP) | 50° C. % Reduction |
|---|---|---|---|---|---|---|---|---|---|
| 2 (Control) | — | 361 | — | 191 | — | 106 | — | 61 | — |
| 3 | 3,30 | 337 | 7 | 186 | 3 | 105 | 1 | 62 | 0 |
| 4 | 5,39 | 233 | 36 | 132 | 31 | 78 | 28 | 46 | 25 |
| 5 | 6,56 | 254 | 30 | 140 | 27 | 81 | 24 | 48 | 21 |
| 6 | 22,39 | 317 | 12 | 171 | 11 | 96 | 9 | 56 | 8 |
| 7 | 0,70 | 296 | 18 | 168 | 12 | 98 | 8 | 60 | 2 |

EXAMPLE 8

This example is comparative and demonstrates the superiority of a fluorinated anioinic compound over a hydrocarbon compound of similar structure in reducing the viscosity of a diluted crude oil. Crude oil A was mixed with diluent A in weight ratio 3 to 1. Doping and viscosity measurements were conducted as previously described.

| Sample | 20° C. Visc. (cP) | 20° C. % Reduction | 30° C. Visc. (cP) | 30° C. % Reduction | 40° C. Visc. (cP) | 40° C. % Reduction | 50° C. Visc. (cP) | 50° C. % Reduction |
|---|---|---|---|---|---|---|---|---|
| Control | 138 | — | 84 | — | 53 | — | 34 | — |
| Doped | 130 | 6 | 78 | 7 | 49 | 8 | 31 | 9 |

| Additive | Dosage (ppm) | 20° C. Visc. (cP) | 20° C. % Reduction | 30° C. Visc. (cP) | 30° C. % Reduction | 40° C. Visc. (cP) | 40° C. % Reduction | 50° C. Visc. (cP) | 50° C. % Reduction |
|---|---|---|---|---|---|---|---|---|---|
| None (control) | — | 361 | — | 191 | — | 106 | — | 61 | — |
| $C_6F_{13}CH_2CH_2S(CH_2)_{10}CO_2^- {}^+N(CH_3)(C_{18}H_{37})_2$ [1] | 65 | 230 | 36 | 135 | 29 | 83 | 22 | 51 | 17 |
| $C_{24}H_{49}CO_2^- {}^+N(CH_3)(C_{18}H_{37})_2$ [2] | 65 | 380 | 0 | 195 | 0 | 105 | 1 | 59 | 3 |
| $C_{24}H_{49}CO_2^- {}^+N(CH_3)(C_{18}H_{37})_2$ [2] | 130 | 365 | 0 | 189 | 0 | 104 | 2 | 59 | 3 |
| $C_{24}H_{49}CO_2^- {}^+N(CH_3)(C_{18}H_{37})_2$ [2] | 500 | 358 | 0 | 190 | 0 | 105 | 1 | 60 | 2 |

[1]Prepared by the neutralization of $C_6F_{13}CH_2CH_2S(CH_2)_{10}CO_2H$ (30% solids in toluene) with $CH_3—N(C_{18}H_{37})_2$ (30% solids in toluene).
[2]Prepared by the neutralization of $C_{24}H_{49}CO_2H$ (30% solids in toluene) with $CH—N(C_{18}H_{37})_2$ (30% solids in toluene.)

EXAMPLE 9

The effectiveness of the compound with the following formula $$C_6F_{13}CH_2CH_2SCH_2\underset{\underset{CH_2OH}{|}}{CH}—O(CH_2CH_2O)_{75}(\underset{\underset{CH_3}{|}}{CH}CH_2O)_{39}(CH_2CH_2O)_{75}H$$

as a viscosity reducer was determined. Crude oil C and diluent C were used in a weight ratio of 3 to 1. One sample of diluted crude was doped with 250 ppm of the above fluorochemical.

EXAMPLES 10–13

In addition to reducing the viscosity of diluted asphaltenic crudes the compounds of the invention inhibit asphaltene precipitation. As mentioned earlier, addition of low surface tension hydrocarbons depeptizes the asphaltene micelle and causes asphaltene deposition. The following examples illustrate the effectiveness of compounds of the formula $$C_6F_{13}CH_2CH_2SCH_2\underset{\underset{CH_2OH}{|}}{CH}—O(—CH_2CH_2O)_a(\underset{\underset{CH_3}{|}}{CH}—CH_2O)_b—(CH_2—CH_2—O)_aH$$

in inhibiting asphaltene deposition. Fifty grams of asphaltic Crude A were mixed with 50 grams of hexane and the mixture was heated at 50° C. with gentle agitation for fifteen minutes. The diluted oil was filtered through a Whatman #2 filter paper and the asphaltene deposit collected was air dried and weighed. Two hundred ppm of potential asphaltene deposition inhibitors were each added to new samples of crude oil and the procedure was repeated. Deposition inhibition is expressed as percent decrease of asphaltenes collected on the filter paper.

| Example # | a | b | Weight of Deposit (g) | % Inhibition |
|---|---|---|---|---|
| Control | — | — | 1.01 | |
| 10 | 3 | 30 | 0.05 | 95 |
| 11 | 5 | 39 | 0.09 | 91 |
| 12 | 6 | 56 | 0.67 | 33 |
| 13 | 5 | 21• | 0.18 | 82 |

EXAMPLE 14

The effectiveness of the compound FC ® 740,[1] that is believed to contain fluorinated alkyl esters, as a viscosity reducer was determined. Crude oil A and dilent A were used in a weight ratio of 3 to 1. One sample of diluted crude was doped with 250 ppm of the previously described fluorochemical.

| | 20° C. | | 30° C. | | 40° C. | | 50° C. | |
|---|---|---|---|---|---|---|---|---|
| Sample | Visc. (cP) | % Reduction | Visc. (cP) | % Reduction | Visc. (cP) | % Reduction | Visc. (cP) | % Reduction |
| Control | 361 | — | 191 | — | 106 | — | 61 | — |
| Doped | 296 | 18.0 | 175 | 8.4 | 108 | −1.9 | 67 | −9.8 |

[1]3M Company.

EXAMPLES 15–18

The effectiveness of the compound with the following formula $$C_6F_{13}CH_2CH_2SCH_2\underset{\underset{CH_2OH}{|}}{CH}-O\left(CH_2CH_2O\right)_6\left(CH\underset{\underset{CH_3}{|}}{C}H_2O\right)_{56}\left(CH_2CH_2O\right)_6H$$

as a viscosity reducer was determined. Crude oil B and diluent B were used in specific weight ratios. Doped samples contained 500 ppm of the above fluorochemical.

| Example | Sample | Diluent B per 100 g Oil B | Temperature (°C.) | Viscosity (cP) | Reduction % |
|---|---|---|---|---|---|
| 15 | Control | 35 | 45 | 39.3 | — |
| | Doped | 35 | 45 | 33.7 | 14.2 |
| 16 | Control | 35 | 5 | 485.5 | — |
| | Doped | 35 | 5 | 329.9 | 32.0 |
| 17 | Control | 25 | 25 | 224.5 | — |
| | Doped | 25 | 25 | 191.6 | 14.7 |
| 18 | Control | 45 | 25 | 59.0 | — |
| | Doped | 45 | 25 | 46.3 | 21.5 |

EXAMPLES 19–35

Based on the use of the previously described evaluation methods the following fluorochemicals exhibit usefulness as viscosity reducers.

| Example # | Fluorochemical | Reference |
|---|---|---|
| 19 | $F_3CCF_2CF_2CF_2CF_2CF_2CF_2CF_2CH_2CH_2S(CH_2)_{11}OH$ | Ger. Offen. DE 2245722, |
| 20 | 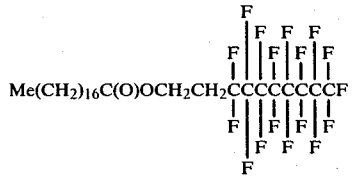 | Jpn. KoKai Tokkyo Koho JP 60/1811 |
| 21 | 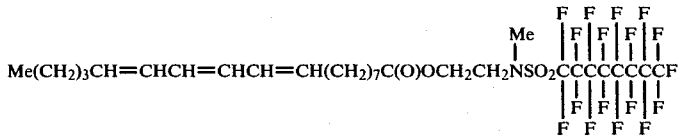 | Eur. Pat. Appl. EP 140525 |
| 22 | 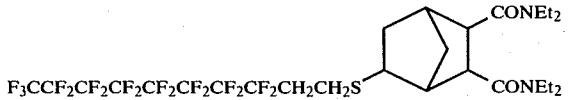 | U.S. Pat. No. 3989725, |
| 23 | $F_3CCF_2CF_2CF_2CF_2CF_2CF_2CF_2CH(OH)CH_2NH(CH_2)_7Me$ | Ger. Offen. DE 2357780, |
| 24 | $F_3CCF_2CF_2CF_2CF_2CF_2CF_2CF_2SO_2Net(CH_2)_{11}OH$ | U.S. Pat. No. 4202706, |
| 25 | 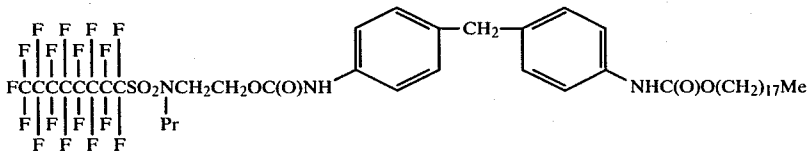 | Jpn. Kokai Tokkyo Koho JP 60/15137 |
| 26 | Poly[oxy(methyl-1,2-ethanediyl)], α-(3,3,4,4,5,5,6,6,7,7,8,8,9,9,10,10,-heptadecafluorodecyl)-ω-hydroxy-(9CI) | Ger. Offen, DE 3306593 |
| 27 | Poly[oxy(methyl-1,2-ethanediyl)], α-[2-[ethyl[(heptadecafluorooctyl)sulfonyl]amino]methylethyl]-ω-hydroxy-(9CI) | Fr. FR 2117416, |
| 28 | 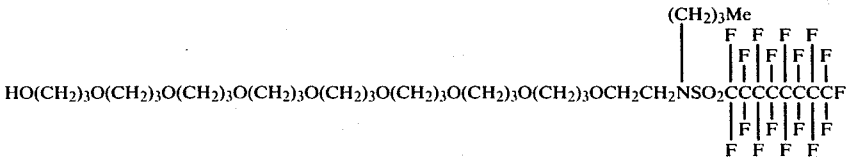 | J. Econ. Entomol., 78(6), 1190-7 |

-continued
| Example # | Fluorochemical | Reference |
|---|---|---|
| 29 | 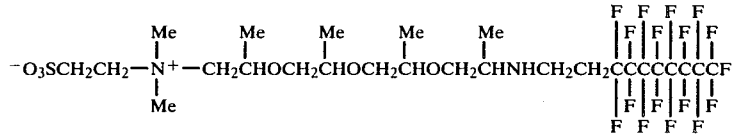 | Eur. Pat. Appl. EP 144844 |
| 30 | $Me(CH_2)_{16}C(O)OCH_2CH_2OCH_2CH_2OCH_2CH_2OCH_2CH_2OCH_2CH_2NMeSO_2CF_2CF_2CF_2CF_2CF_2CF_2CF_2CF_3$ | Japan. Kokai JP 53/31582 |
| 31 | 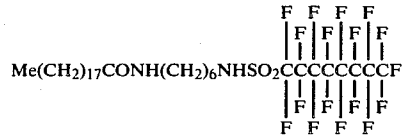 | Jpn. Kokai Tokkyo Koho JP 58/70806 |
| 32 | 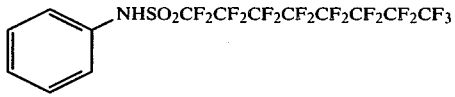 | |
| 33 | 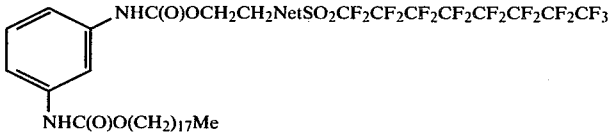 | U.S. Pat. No. 3575899, |
| 34 | 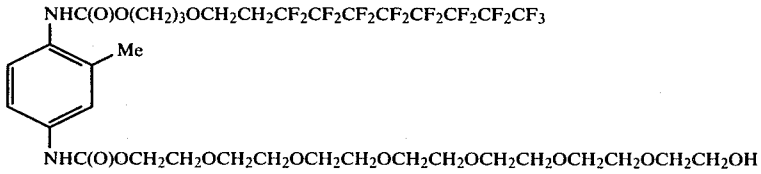 | Japan. Kokai JP 51/144730 |
| 35 | Poly[oxy(methyl-1,2-ethanediyl)], ω-[(3,3,4,4,5,5,6,6,7,7,8,8,9,9,10,10-heptadecafluorodecyl)oxy]-ω'-hydroxy-α,α'-[(methylphenylene)bis(iminocarbonyl)]bis-(9CI) | Japan Kokai JP 51/151126 |

EXAMPLES 55–74

The fluorinated addition polymers described in the following examples exhibit usefulness as paraffin viscosity reducers. Addition of 1% dodecyl mercaptan to the monomer mixture yields polymers having low enough molecular weight to be oil soluble.

| Example | $R_f$ Monomer | Parts | Comonomer | Parts |
|---|---|---|---|---|
| 36 | $C_8F_{17}SO_2N(CH_3)CH_2CH_2OOCCH{=}CH_2$ | 80 | Octadecyl acrylate | 20 |
| 37 | $C_6H_{13}C_2H_4OOCC(CH_3){=}CH_2$ | 65 | Tridecyl methacrylate | 35 |
| 38 | $C_6F_{13}C_2H_4SC_2H_4OOCCH{=}CH_2$ | 70 | $CH_2{=}CHCOO(CH_2CH_2O)_6(CH(CH_3)CH_2O)_{56}(CH_2CH_2O)_6{-}H$ | 30 |
| 39 | $C_8F_{17}C_2H_4OOCC(CH_3){=}CH_2$ | 40 | Decyl methacrylate | 60 |
| 40 | $C_8F_{17}C_2H_4N(CH_3)C_2H_4OOCC(CH_3){=}CH_2$ | 45 | 3,5,5-Trimethylhexyl methacrylate | 55 |
| 41 | $C_2F_5C_6F_{10}CH_2OOCCH{=}CH_2$ | 60 | $C_{22}H_{45}OOC(CH_3){=}CH_2$ | 40 |
| 42 | $C_7F_{15}CH_2OOCCH{=}CH_2$ | 90 | Decyl acrylate | 10 |
| 43 | $C_7F_{15}CON(CH_3)C_2H_4OOCCH{=}CH_2$ | 50 | Lauryl methacrylate | 50 |
| 44 | $(CF_3)_2CF(CF_2)_6CH_2CH(OH)CH_2OOCCH_2CH_2{=}CH_2$ | 60 | 2,6,8-Trimethyl-4-nonyl methacrylate | 40 |
| 45 | $(CF_3)_2CFOC_2F_4C_2H_4OOCCH{=}CH_2$ | 35 | Lauryl acrylate | 65 |
| 46 | $C_8F_{17}C_2H_4SO_2N(C_3H_7)C_2H_4OOCCH{=}CH_2$ | 70 | Tridecyl acrylate | 30 |
| 47 | $C_7F_{15}C_2H_4CONHC_4H_8OOCCH{=}CH_2$ | 50 | Stearyl methacrylate | 50 |
| 48 | $C_3F_7(\underset{\underset{CF_3}{\vert}}{C}FCF_2O)_2\underset{\underset{CF_3}{\vert}}{C}FCH_2OOCCH{=}CH_2$ | 80 | Stearyl acrylate | 20 |
| 49 | | | | |
| 50 | $C_7F_{15}COOCH_2C(CH_3)_2CH_2OOCC(CH_3){=}CH_2$ | 75 | Ocatadecyl acrylate | 25 |
| 51 | $C_8F_{17}SO_2N(C_2H_5C_4H_8OOCCH{=}CH_2$ | 10 | Lauryl methacrylate | 90 |
| 52 | $(C_3F_7)_2C_6H_3SO_2N(CH_3)C_2H_4OOCCH{=}CH_2$ | 60 | 2,6,8-trimethyl-4-nonyl methacrylate | 40 |
| | 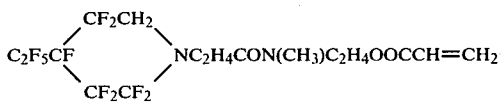 | 40 | Decyl methacrylate | 60 |
| 53 | $C_6F_{17}CF{=}CHCH_2N(CH_3)C_2H_4OOCCH{=}CH_2$ | 50 | $C_{22}H_{45}OOC(CH_3){=}CH_2$ | 50 |
| 54 | $C_8F_{17}SO_2N(C_4H_9)C_2H_4OCOCH{=}CH_2$ | 35 | Stearyl acrylate | 65 |
| 55 | $C_8F_{17}SO_2N(C_2H_5)C_2H_4OCOCH(CH_3){=}CH_2$ | 50 | Tridecyl methacrylate | 50 |

In the foregoing examples 36–55, the monomers and dodecyl mercaptan are dissolved in tetrahydrofuran, an azo initiator, azo-bis (isobutyl nitrile), is added in an amount of about 0.1% by weight based on the amount of monomer, and the solutions are placed in ampules which are evacuated and sealed, and the polymerization conducted at 100° C. overnight in an agitating batch.

EXAMPLES 56–65

Hexadecane contact angles for compounds of the formula $$R_fCH_2CH_2SCH_2\underset{\underset{CH_2OH}{|}}{CH}-O\left(CH_2CH_2\right)_a\left(\underset{\underset{CH_3}{|}}{CH}-CH_2O\right)_b\left(CH_2CH_2O\right)_aH \quad \text{(U.S. Pat. No. 4,310,698)}$$

were determined employing the procedure previously described. Steel coupons were coated using toluene solutions.

| Example # | $R_f$ | a | b | Contact Angle, Degrees[1] |
|---|---|---|---|---|
| 56 | $C_6F_{13}$ | 11 | 16 | 34 ± 1 |
| 57 | 2% $C_4F_9$, 38% $C_6F_{13}$, 35% $C_8F_{17}$ | 11 | 16 | 40 ± 1 |
| 58 | 20% $C_{10}F_{21}$, 5% $F_{12}F_{25}$ | | | |
| 59 | $C_6F_{13}$ | 6 | 56 | 25 ± 1 |
| 60 | 2% $C_4F_9$, 38% $C_6F_{13}$, 35% $C_8F_{17}$ | 6 | 56 | 25 ± 1 |
| 61 | 20% $C_{10}F_{21}$, 5% $C_{12}F_{25}$ | | | |
| 62 | $C_6F_{13}$ | 5 | 21 | 32 ± 1 |
| 63 | $C_6F_{13}$ | 12 | 21 | 33 ± 1 |
| 64 | $C_6F_{13}$ | 3 | 30 | 25 ± 1 |
| 65 | $C_6F_{13}$ | 10 | 30 | 31 ± 1 |
| 66 | $C_6F_{13}$ | 5 | 39 | 25 ± 1 |
| 67 | $C_6F_{13}$ | 22 | 39 | 39 ± 1 |

[1]Average of at least four measurements.

All contact angles are greater than fifteen degrees indicating that the tested compounds are useful as asphaltene viscosity reducers. Since many of the above compounds are soluble in hexadecane, the angle may decrease as the coating dissolves in hexadecane therefore, only initial angles should be considered.

EXAMPLE 66

A mixture of 26.8 g (0.05 moles) of 3-(1,1,2,2-tetrahydroperfluorodecanethio)-1,2-epoxypropane was reacted with 14.9 g (0.05 moles) of octadecyldimethylamine and 3.35 g (0.055 moles) of acetic acid in 179 grams toluene at 50°-60° for 18 hours.

The clear reaction product has the structure $C_8F_{17}CH_2CH_2SCH_2CH(OH)CH_2N^+(CH_3)_2C_{18}H_{37}O_2^-CCH_3$ and is soluble at a 20% concentration in toluene to 0° C.

The product was coated on a coupon of cold rolled mild steel SAE 1010 and contact angle measurements were run. For hexadecane the angle was 50° (untreated steel=0°, i.e. it wets completely). Its surface tension in toluene at 1% was 26.0 dynes/cm (toluene =28.2).

EXAMPLES 67–69

Hexadecane contact angles were determined for some commercial fluorochemicals. Steel coupons were coated using toluene solutions.

| Example # | Trade Name, Source | Contact Angle, Degrees[1] |
|---|---|---|
| 67 | Fluorad ® FC 430, 3M Co.[3] | 40 ± 1 |

-continued

| Example # | Trade Name, Source | Contact Angle, Degrees[1] |
|---|---|---|
| 68 | Fluorad ® FC 740, 3M Co.[3] | 45 ± 3[2] |
| 69 | Fluorad ® FC 742, 3M Co.[3] | 64 ± 2 |

[1]Average of at least four measurements.
[2]The angle rapidly decreases to about 20 degrees.
[3]Listed as fluorinated alkyl esters.

The above contact angles indicate that the compounds of the examples are useful as asphaltene viscosity reducers. The rapid contact angle decrease (from 45° to 20°) for the FC 740 coated coupon is attributed to the dissolution of FC 740 in hexadecane.

EXAMPLE 70

Methyl ethyl ketone (600 g) was charged to a 2 l flask fitted with a stirrer, thermometer, nitrogen inlet and a condenser protected with a drying tube. 2,3-Bis(1,1,2,2-tetrahydroperfluoroalkylthio) butane-1,4-diol (600 g; 0.571 mole)* was added together with a 1:1 mixture of 2,2,4-trimethylhexamethylene diisocyanate and 2,4,4-trimethylhexamethylenediisosycanate (80.16 g; 0.381 mole). All reagents were rinsed in with an additional 50 g MEK. The solution was heated to boiling and 50 g solvent was removed by distillation to affect azeotropic drying of all materials. Then dibutyltindilaurate (0.692 g; $1.14\times10^{-3}$ mole; 2 mole % based on diol) was added as a catalyst and the solution was heated under reflux for 6 hours, when the reaction was judged to be complete by the absence of the N=C=O infrared band at 2270 $cm^{-1}$. The solution was cooled to room temperature (25°) and diluted with MEK to a total of 2042 g (33 ⅓% solids). A portion of the above material was taken to dryness. A quantitative recovery of a resinous material was obtained. Elemental analysis showed 52.8% F (theory: 53.4% F). Infrared bands at 3460 $cm^{-1}$ (O—H str.), 3340 $cm^{-1}$ (N—H str.) and 1705 $cm^{-1}$ (C=) str.) confirmed the structure of the hydroxy-terminated urethane prepolymer.

* The diol has the formula $$\begin{array}{l} R_fCH_2CH_2SCHCH_2OH \\ \quad\quad\quad\quad\quad\quad | \\ R_fCH_2CH_2SCHCH_2OH \end{array}$$

where $R_f$ is a mixture of perfluoroalkyl chains consisting of $C_6F_{13}$, $C_8F_{17}$ and $C_{10}F_{21}$ (U.S. Pat. No. 4,001,305).

The hydroxy-terminated prepolymer (53.7 g solution, 17.9 g solids) was treated further at 75° with dimer acid derived diisocyanate (6.0 g; 0.01 mole) (DDI, HENKEL Company) for two hours, then the urethane chain was completed by the additon of trimethylhexamethylene diisocyanate (2,2,4 and 2,4,4 isomer mixture) (1.05 g; 0.005 mole) and N-methyldiethanolamine (1.19 g; 0.01 mole). Reaction was complete in three hours, as shown by the disappearance of the N=C=O band (2270 $cm^{-1}$) in the infrared spectrum. Hexadecane contact angle on steel coupons was 73±1 degrees.

What is claimed is:

1. A method of reducing the viscosity of asphaltenic crude oils comprising incorporating into said crude oil an effective viscosity reducing amount of an oil soluble organic compound and about 1 to about 80 weight percent based on the weight of the total composition of an asphaltenic oil compatable low viscosity diluent; said oil soluble organic compound being of the formula $$[(R_f)_nR']_mZ$$

wherein $R_f$ is an inert, stable, oleophobic and hydrophobic fluoroaliphatic group having about 4 to about 20 carbon atoms;

n is an integer from 1 to 3;

R' is a direct bond or an organic linking group having a valency of n+1 and is covalently bonded to both $R_f$ and Z;

m is an intger of from 1 to about 5000; and

Z is a hydrocarbyl containing residue having a valency of m and being sufficientlky oleophilic so as to impart an oil solubility to said compounds of at least 10 parts per million by weight of asphaltenic crude oil; and said low viscosity diluent having a viscosity at 20° C. between about 25 and about 300 centipoise.

2. The method of claim 1 wherein said diluent is incorpporated into said crude oil in an amount between about 5 and about 50 weight percent based on the weight of the total compositions.

3. The method of claim 1 wherein said asphaltenic crude oil contains between about 1% and 20% by weight asphaltenes based on the weight of said crude oil.

4. The method of claim 1 wherein said asphaltenic crude oil contains between about 5% and 20% by weight asphaltenes based on the weight of said crude oil.

5. The method of claim 1 wherein said oil soluble organic compound is sufficiently hydrophobic such that a steel coupon treated with said oil soluble organic compound to thoroughly coat the same exhibits a contact angle with hexadecane of at least 15 degrees.

6. The method of claim 1 wherein said $R_f$ is a straight or branched perfluoroalkyl, perfluoroalkoxy substituted perfluoroalkyl, omega-hydroperfluoroalkyl, or perfluoroalkenyl, or mixtures thereof, each $R_f$ having 4 to 20 carbon atoms.

7. The method of claim 6 wherein said $R_f$ is perfluoroalkyl.

8. An asphaltenic crude oil composition comprising (a) an asphaltenic crude oil containing between about 1% and 20% asphaltenes;

(b) between about 10 to about 500 parts per million by weight, based on the weight of said asphaltenic crude oil, of a viscosity reducing oil soluble organic compound of the formula $$[(R_f)_nR']_mZ$$

wherein $R_f$ is an inert, stable, oleophobic and hydrophobic fluoroaliphatic group having 4 to about 20 carbon atoms;

n is an integer from 1 to 3;

R' is a direct bond or an organic linking group having a valency of n+1 and is covalently bonded to both $R_f$ and Z;

m is an integer of from 1 to about 5000; and

Z is a hydrocarbyl containing residue having a velency of m and being sufficeintly oleophilic so as to impart an oil solubility to said compounds of at least 10 parts per million by weight of said asphaltenic crude oil; and (c) a low viscosity asphaltenic oil compatable diluent, having a viscosity at 20° C. between about 25 and about 300 centipoise, in an amount between about 1 and about 80 percent by weight based on the weight of said composition.

9. The composition of claim 8 wherien said asphaltenic crude oil contains between about 5% and about 20% asphaltenes.

10. The composition of claim 8 wherein said diluent has a viscosity at 20° C. of between about 25 and about 200 centipoise.

11. The composition of claim 10 wherein said diluent is present in an amount between 5 and 50 percent by weight based on the weight of the total composition.

12. The composition of claim 8 wherein $R_f$ is a straight or branched chain perfluoroalkyl, perfluoroalkoxy substituted perfluoroalkyl, omega-hydro perfluoroalkyl, perfluoroalkyenyl, or mixtures thereof, each $R_f$ having 4 to 20 carbon atoms.

13. The composition of claim 8 wherein said $R_f$ is perfluoroalkyl having 4 to 20 carbon atoms or mixtures thereof.

* * * * *